United States Patent [19]

Moore, Jr. et al.

[11] Patent Number: 4,924,816

[45] Date of Patent: May 15, 1990

[54] WATER HEATER WITH FLAME SPILL-OUT PREVENTION ARRANGEMENT

[75] Inventors: Henry J. Moore, Jr., Playa Del Rey; Bijan Gidanian, Granada Hills, both of Calif.

[73] Assignee: Mor-Flo Industries, Inc., Cleveland, Ohio

[21] Appl. No.: 345,296

[22] Filed: May 1, 1989

[51] Int. Cl.[5] ..... F22B 5/00

[52] U.S. Cl. ..... 122/17; 122/14

[58] Field of Search ..... 122/14, 17, 18; 431/153, 154, 142; 126/361

[56] References Cited

U.S. PATENT DOCUMENTS

| | | | |
|---|---|---|---|
| 1,828,023 | 10/1931 | Brill | 431/154 |
| 2,687,747 | 8/1954 | Bock | 122/17 X |
| 3,091,223 | 5/1963 | Vitale | 122/17 |
| 3,110,302 | 11/1963 | Buehl | 126/363 |
| 4,328,791 | 5/1982 | Moore, Jr. et al. | 122/17 X |

*Primary Examiner*—Edward G. Favors

*Attorney, Agent, or Firm*—Body, Vickers & Daniels

[57] ABSTRACT

A water heater having the inner door that closes the inner access opening leading into the combustion chamber formed as a component part of a unitary manifold assembly which also includes the main burner with its manifold gas supply tube, the pilot burner with its gas supply tube, and the pilot burner control thermocouple with its support tube. The inner door thus may not be removed for servicing of the water heater unless the complete manifold assembly is removed from the inner access opening, in which case the water heater is then rendered inoperative and incapable of main burner ignition to produce burner flames which could otherwise spill-out through an uncovered inner access opening left open by an unreplaced inner door. The inner door component of the manifold assembly has a pilot burner lighting port which is normally closed off by a spring loaded door and which also enables observation of the pilot and main burner flames.

22 Claims, 4 Drawing Sheets

WATER HEATER WITH FLAME SPILL-OUT PREVENTION ARRANGEMENT

BACKGROUND OF THE INVENTION

This invention relates in general to gas fired water heaters and, more particularly, to a flame roll-out or spill-out prevention arrangement therefor.

Water heaters such as are commonly employed to provide the hot water supply in modern day homes are generally provided with a removable inner door normally covering an inner access opening leading into the combustion chamber at the bottom of the water heater, to provide access to the combustion chamber for servicing purposes such as relighting of the pilot light when it becomes extinguished for some reason or adjustment of the main burner or the pilot light actuated thermocouple that controls the supply of gas to the pilot light burner. After its removal, this inner door is not always replaced after the pilot light is relit or the water heater serviced. As a result, the combustion products and burner flame which form in the combustion chamber each time the water heater functions to ignite the main burner, can then spill out of the uncovered inner access opening and thereby create a dangerous operating condition. The problem further intensifies if the water heater flue way becomes restricted or blocked, or if the pressure at the flue outlet of the water heater exceeds the air inlet pressure due to down draft.

SUMMARY OF THE INVENTION

The present invention contemplates a new and improved water heater which overcomes all of the above referred to problems and others and provides a water heater of such type which is of simple construction and which eliminates the possibility of flame spill-out through an access opening to the combustion chamber being left open as by accidental failure to replace the closure door therefor after being removed for water heater servicing purposes.

Briefly stated, in accordance with the principal aspect of the invention, the problem of flame spill-out through an unclosed access opening to the combustion chamber is eliminated by making the inner door which normally closes the inner access opening a permanent component part of a manifold burner assembly which seals off the combustion chamber inner access opening when the assembly is in position. The inner door of the assembly then may not be removed unless the complete assembly is removed from the water heater, in which case the water heater is then rendered inoperative and cannot function to ignite the main burner with possible spill-out of the burner flame or combustion products through the open access opening leading into the combustion chamber. The complete manifold assembly includes the main burner with its manifold gas supply tube, the pilot light burner with its gas supply tube, the thermocouple and support tube which controls the supply of gas to the pilot burner, and the inner door which covers the inner access opening leading into the combustion chamber of the water heater.

In accordance with a further aspect of the invention, to enable lighting of the pilot burner or in case the flame thereof should for some reason become extinguished, a small size lighting port or opening is provided on the inner door which also provides a means for observing the pilot and main burner flames. A spring-loaded door is movably or swivably mounted on the inner door to cover and seal off the lighting port once the pilot burner is lighted.

In accordance with a still further aspect of the invention, the need for a pilot burner lighting port may be eliminated by employing a piezo ignitor, which is a mechanical spark generating device, inside the combustion chamber to light the pilot burner. In this case, only a viewing port opening covered with a permanently attached tempered glass window, need be provided on the inner door for flame observation.

The principal object of the invention is to provide a water heater of the type having a side access opening to the combustion chamber normally closed by an inner door and in which the possibility of flame spill-out through the access opening is eliminated regardless of whether the inner door is in its closed position.

Another object of the invention is to provide a water heater of the above referred to type in which the inner door constitutes a component part of a unitary manifold assembly including the main burner, the pilot burner, and the pilot burner control thermocouple of the water heater whereby the water heater is rendered inoperative on removal of the door from its closed position covering the access opening.

Still another object of the invention, is to provide a water heater of the above referred to type in which a pilot burner lighting port with a movable closure door therefor is provided on the inner door component of the manifold assembly.

A further object of the invention, is to provide a water heater of the above referred to type having a piezo ignitor for lighting the pilot burner and a glass covered port opening in the inner door for observation of the pilot flame.

Further objects and advantages of the invention will be apparent from the following detailed description of a preferred species thereof and from the accompanying drawings.

DESCRIPTION OF THE PREFERRED EMBODIMENT

Figure 1A:
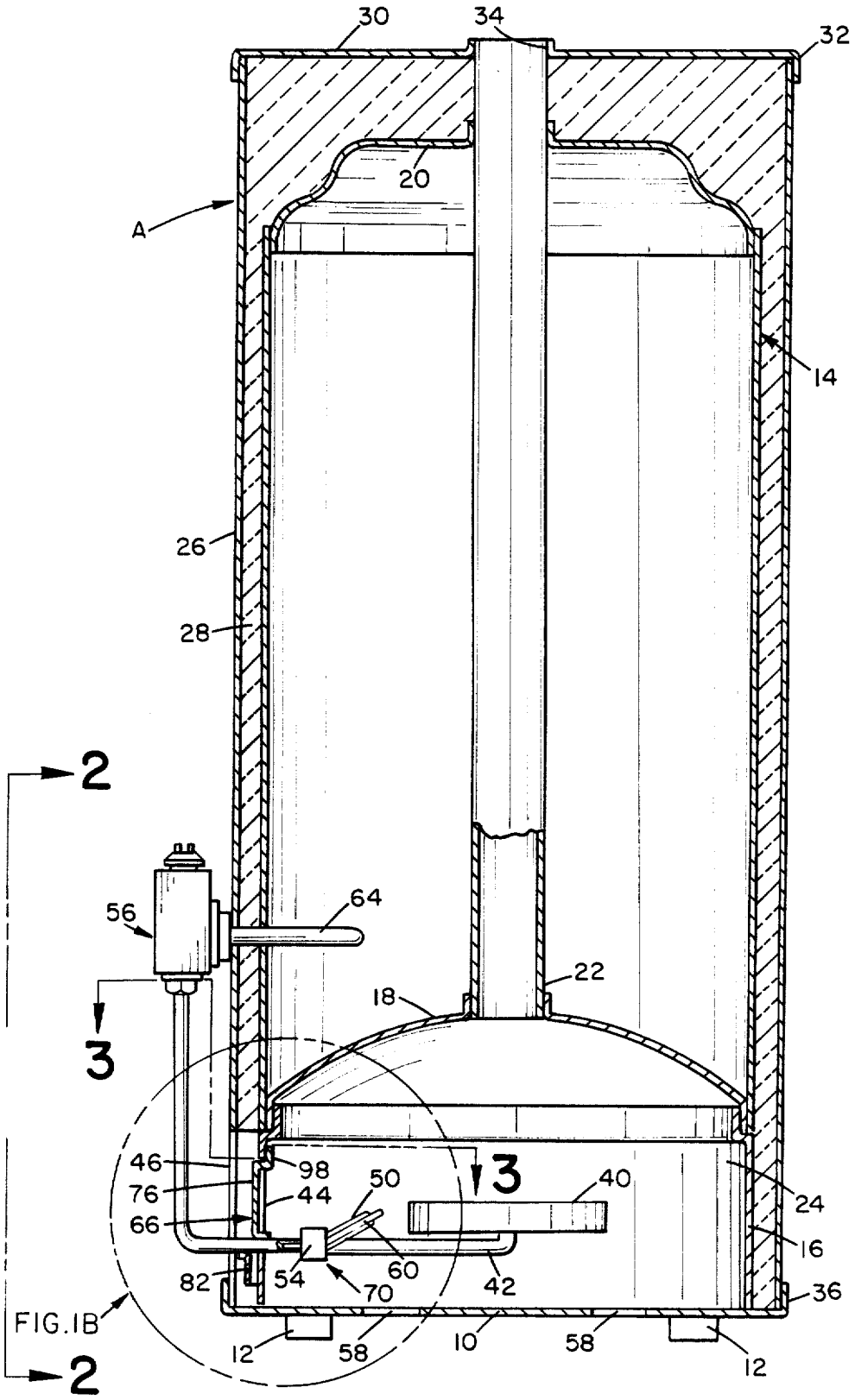
FIG. 1A is a vertical sectional view of a water heater according to the invention.

Referring now to the drawing wherein the showings are for the purposes of illustrating the preferred embodiment of the invention only and not for the purposes of limiting same, the figures show a gas-fired water heater A of a type commonly used at present in modern homes to provide a supply of hot water therefor. The water heater A comprises, in general, a circular sheet metal base 10 having a plurality of support legs 12 and adapted to support an upright, insulated, underfired water storage tank 14 which is seated on a drum-like sheet metal supporting or skirt member 16 resting on the circular base 10.

The tank 14 is cylindrical in section and is provided with circular shaped, sheet metal bottom and top end closure members 18 and 20, respectively, and with a central flue 22 extending coaxially through the tank from the bottom member 18 through the top member 20 to which the flue is joined by water-tight connections. The tank bottom 18 rests on, and is spaced vertically above, the base 10 of the water heater A by the drum-like supporting member 16 to provide a combustion chamber 24 directly beneath the tank 14.

As shown, the tank 14 is encased within a sheet metal drum or casing 26 which projects upwardly above the top 20 of the tank and is spaced radially outwardly from the tank to provide a circumferentially continuous uniform space between the tank and the casing. This space is preferably filled with a suitable heat insulating material 28 such as fiber glass or the like. The drum or casing 26 is provided with a top sheet metal closure plate 30 having a circumferentially continuous downwardly directed flange 32 which telescopically fits over the uppermost end of the drum 26. The top closure plate 30 is provide with a central aperture 34 through and within which the flue 22 projects upwardly and is supported. The lower end of the casing 26 telescopically fits inside an upwardly directed peripheral flange 36 on the base member 10 to locate the casing in centered position thereon.

Supported centrally within the combustion chamber 24 of the hot water heater A is a conventional surface type main combustion gas burner 40 for heating the water stored in the tank 14. The gas burner 40 is connected to, and supported in place, centrally within the combustion chamber 24 by an incoming gas supply line or manifold tube 42 which extends horizontally into the combustion chamber through aligned inner and outer combustion chamber access openings 44 and 46 respectively provided in the inner drum-like supporting member 16 and in the outer casing 26 of the tank adjacent the lower end thereof and opposite the combustion chamber 24. A continuously operating pilot light burner 50 is also supported within the combustion chamber 24 by an incoming gas supply line or tube 52 which extends horizontally into the combustion chamber 24 through the access openings 44 and 46 in a position closely alongside of the manifold tube 42. The pilot light burner 50 is located at a position closely alongside the periphery of the main gas burner 40 so as to effectively ignite the gas jets emanating therefrom when the water heater functions to turn on the gas supply to the main burner. As shown, the pilot light burner 50 is fixedly supported in such position relative to the main gas burner 40 within a mounting bracket 54 welded or brazed to the manifold tube 42. The gas supply lines 42 and 52 to the main burner 40 and the pilot light burner 50 are adapted to be connected to a gas supply source (not shown) through thermostatically controlled valve or water heater control means 56 which is mounted into the side of the water heater tank 26. Combustion air is supplied to the combustion chamber 24 through a plurality of circumferentially spaced arcuate apertures 58 provided in the base 10 of the water heater A.

The pilot light burner 50 has a thermocouple 60 unitarily mounted therewith in the mounting bracket 54 in a position to be continuously actuated by the pilot light. The thermocouple 60 is connected to the valve or water heater control means 56 by electrical conductor means extending within a tube 62 which extends horizontally into the combustion chamber 24 through the inner and outer access openings 44 and 46 of the water heater and closely alongside the incoming pilot burner gas supply tube 52. The thermocouple 60 operates in a conventional manner to shut-off the gas supply to the pilot burner 50 if it stops burning for any reason. It will be understood that the water heater control or valve means 56 operates in a well known manner to normally deliver a continuous flow of gas to the pilot light burner 50 and to intermittently supply a larger amount of gas to the main burner 40 through the manifold tube 42 in response to a reduction in the temperature of the water within the tank 14, as determined by a sensing element 64 extending into the tank and immersed in the water stored therein. Outwardly of the tank casing 26, the gas supply tubes 42 and 52 and the thermocouple tube 62 are all bent upwardly alongside the tank casing and are connected to the valve or water heater control means 56 mounted on the side of the tank casing.

To prevent dangerous roll-out or spill-out, through the access opening 44 and 46, of the burner flames and combustion products each time the water heater functions to ignite the main burner 40, an inner door 66 of arcuate shape conforming to the cylindrical curvature of the skirt portion 16, is provided to cover and close off the inner access opening 44 leading into the combustion chamber 24. Heretofore, such inner closure doors for such inner access openings of underfired water heaters were made removable to provide access through the openings to the combustion chamber for servicing purposes such as to relight the pilot burner if for some reason the pilot light should become extinguished or for adjusting either the pilot light thermocouple or the main burner. This removable door, however, was not always replaced on completion of the servicing operation so that the inner access opening was then left open, thereby permitting the aforementioned roll-out or spill-out of the burner flames or combustion products on each reignition of the main burner.

Figure 3:
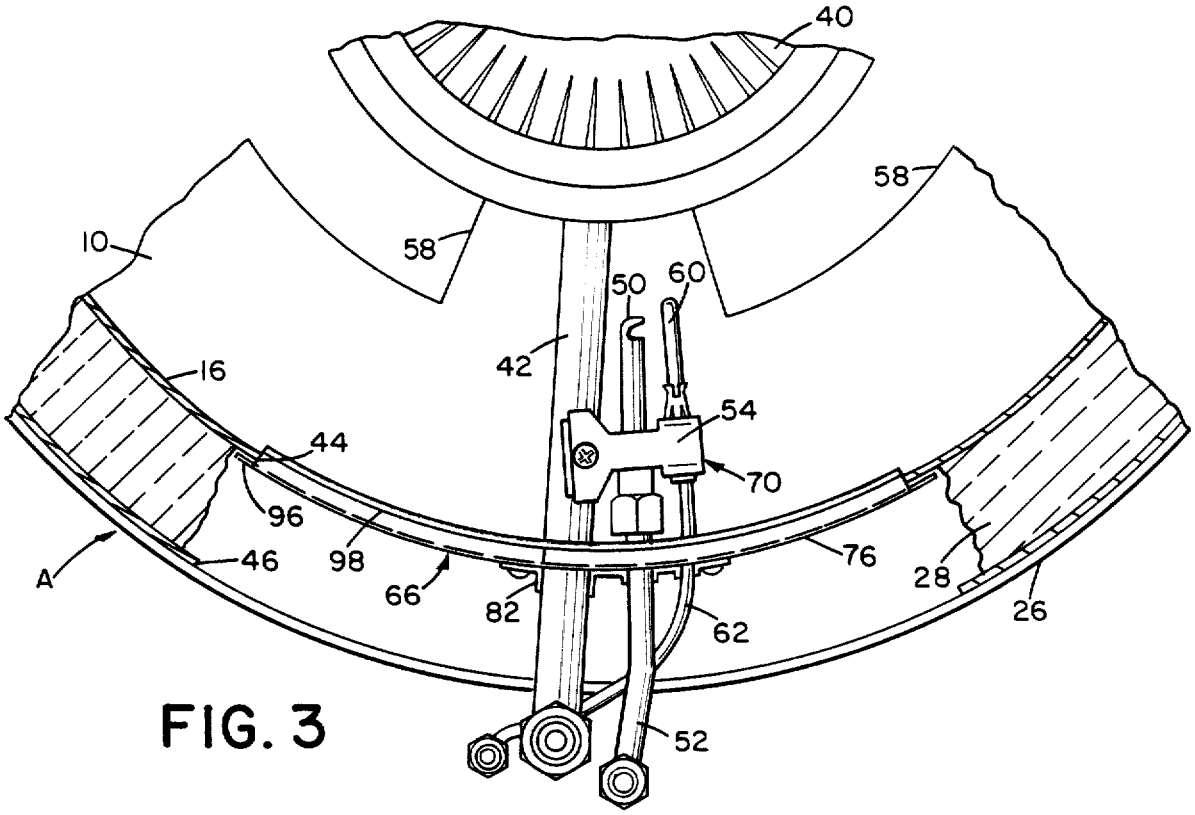
FIG. 3 is a fragmentary plan view, on an enlarged scale, of the unitary manifold assembly of the main burner, pilot burner, pilot burner control thermocouple, and inner closure door of the water heater as viewed on the line 3—3 of FIG. 1A.

In accordance with the invention, this problem is eliminated by making the arcuate shaped inner closure door 66 for the inner access opening 44 a component part of a unitary manifold assembly 70 (FIG. 3) which also includes the manifold tube 42 and main burner 40; the pilot light burner 50 and its gas supply tube 52, the thermocouple 60 and its support tube 62, and the mounting bracket 54 for supporting the pilot light burner 50 and the thermocouple 60 in place on the manifold tube 42. With such an arrangement, the inner door 66 cannot be removed unless the complete manifold assembly 70 is removed, in which case the water heater is then rendered inoperative and the possibility of flame spill-out avoided. To light the pilot burner 50 of the installed manifold assembly 70, a lighting port or small opening 72 is provided in the door 66, which opening also provides a means for observing the pilot and main burner flames. A closure door 74 with a coiled loading spring 75 is swivably mounted on the inner door 66 to cover and seal the lighting port 72 once the pilot burner 50 is lighted. The need for a lighting port, however, may be eliminated if a piezo ignitor, which is a mechanical spark generating device, is employed to light the pilot burner 50, the piezo ignitor being operable from the exterior of the water heater to produce an ignitor spark within the combustion chamber 24. In such case, an observation window, such as the lighting port 72 covered with a permanently attached tempered glass window, provides the means for flame observation.

Figure 4:
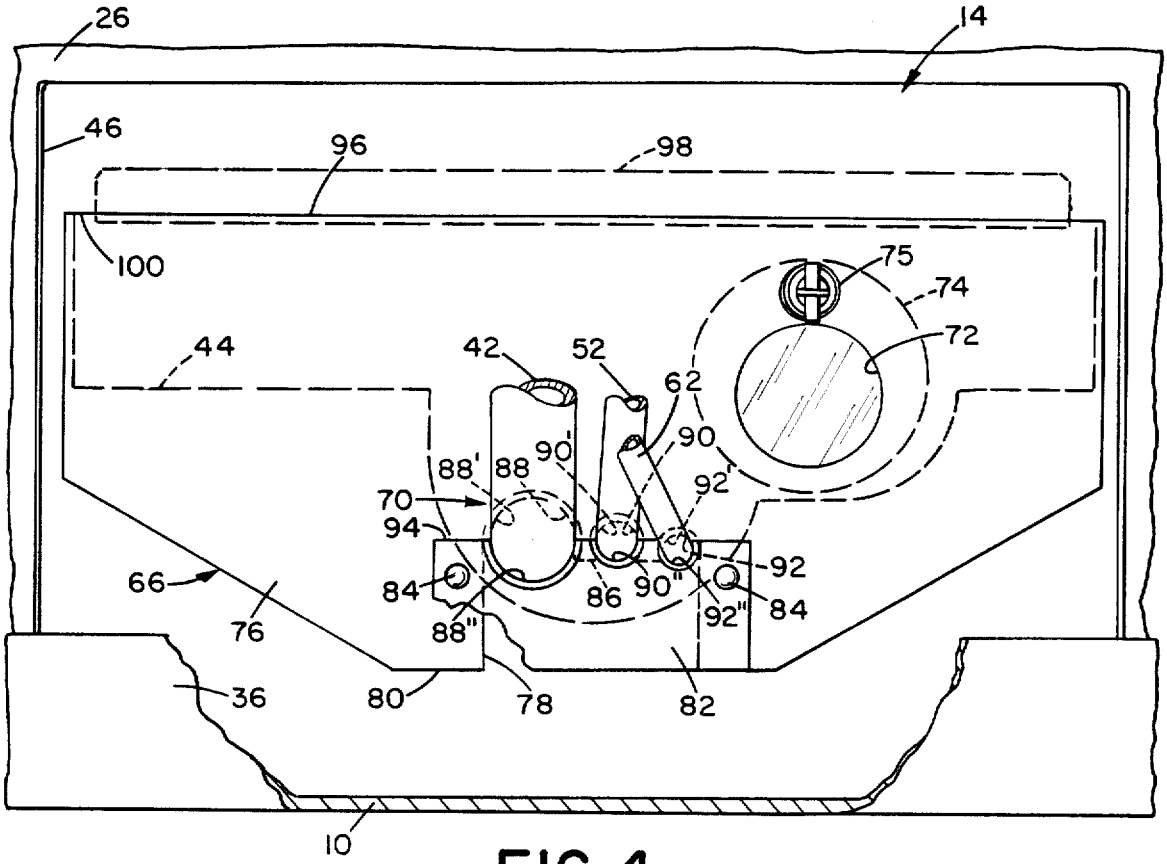
FIG. 4 is a fragmentary front elevational view, on an enlarged scale, of the unitary manifold assembly shown in mounted position on the water tank supporting skirt of the water heater.
Figure 6:
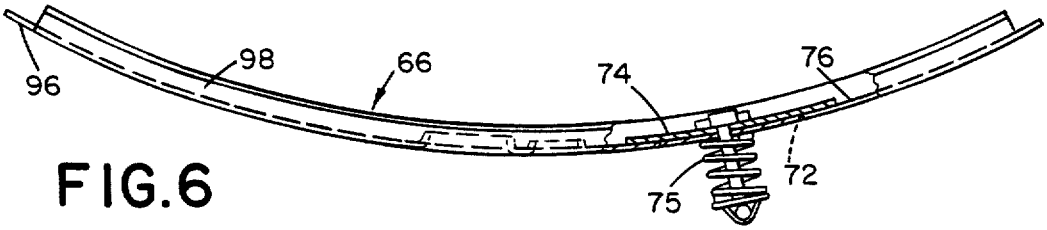
FIG. 6 is a plan view of the main door section of the inner door component of the unitary manifold assembly.
Figure 5:
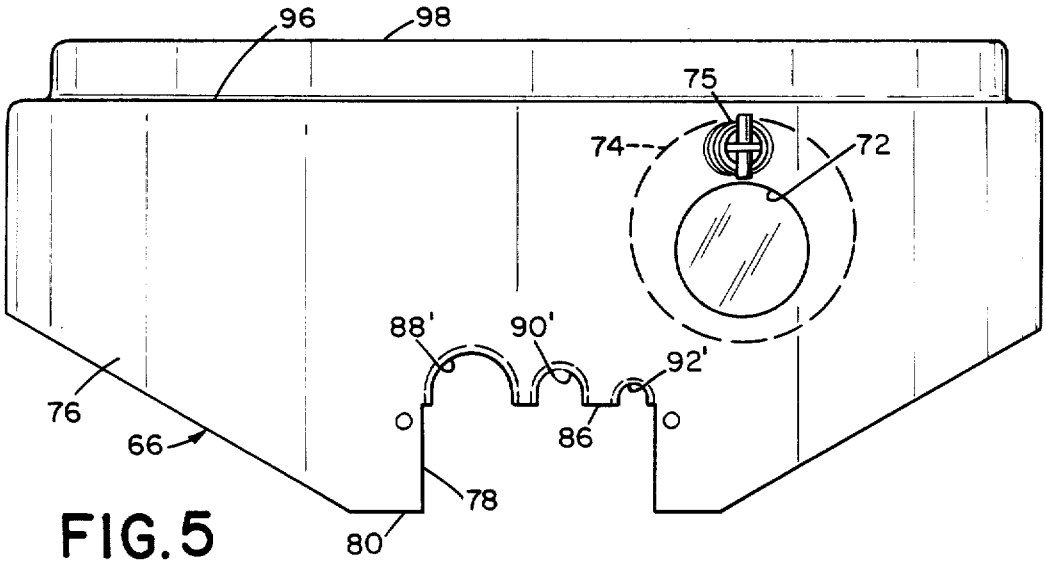
FIG. 5 is a front elevational view, on an enlarged scale, of the main door section of the inner door component of the unitary manifold assembly shown in FIG. 3.
Figure 8:
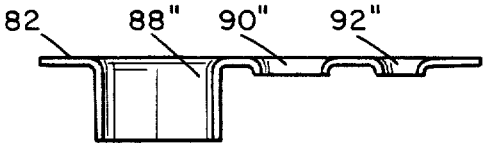
Figure 7:
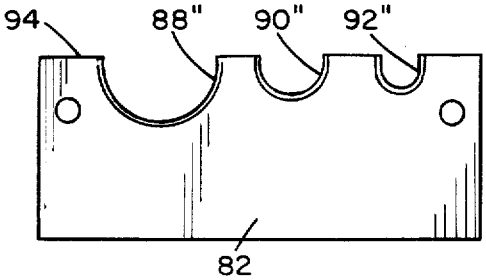
FIG. 7 is a front elevational view, on an enlarged scale, of the mounting bracket portion of the inner door component of the unitary manifold assembly; and, FIG. 8 is a plan view of the mounting bracket portion of the inner door component of the unitary manifold assembly.

As shown in FIG. 4, the inner closure door 66 component of the manifold assembly 70 is of a size and configuration to engage against the outer side of the skirt member 16 completely around and covering over the inner access opening 44 formed in the skirt member 16 of the water heater, and it is composed of an arcuate shaped main upper door section 76 formed of sheet steel conforming to the cylindrical curvature of the skirt member 16 and provided with a central notch opening 78 in its lower edge 80, and a small mounting bracket plate portion 82 of sheet steel permanently secured as by rivets 84 to the main door section 76, preferably with an interposed gasket means (not shown), in a position spanning and covering the notch opening 78. The horizontal inner end 86 of the notch opening 78 in the main door section 76 is provided with a plurality of downwardly opening, flanged, side-by-side semi-circular recesses 88', 90' and 92' matching and snugly fitting around the respective manifold tube 42, pilot burner gas supply tube 52, and the thermocouple tube 62. The horizontal upper edge 94 of the bracket plate portion 82 overlaps the inner end 86 of the notch 78 in the main door section 76 and is provided with upwardly opening, flanged, side-by-side semi-circular recesses 88', 90' and 92' corresponding in size to and disposed opposite the downwardly opening semi-circular recesses 88", 90" and 92" in the main door section 76 to form therewith complete circular-shaped apertures or passageways 88, 90 and 92 in the closure door through and within which the manifold tube 42, pilot burner gas supply tube 52, and thermocouple tube 62 extend and have a snug fit to form a sealed passageway therefor. Suitable gasket means (not shown) may be interposed between the tubes 42, 52 and 62 and the passageways 88, 90 and 92 to provide a seal therebetween.

The upper main door section 76 of the inner door 66 is provided across its horizontal top edge 96 with an inwardly offset upstanding arcuate flange or lip portion 98 to fit snugly underneath and behind the horizontal upper edge 100 of the inner access opening 44 in the skirt member 16 to hold, in conjunction with the holding action of the gas supply tubes 42 and 52 and thermocouple tube 62, the door 66 in position covering the inner access opening 44 in the skirt member 16. A gasket (not shown) may be interposed between the inner door 66 and the skirt member 16, bordering the inner access opening 44 therein, to seal the door against the outer side of the skirt member.

With the manifold assembly 70 according to the invention mounted in position on the water heater A, the inner access opening 44 is always closed off by the inner door component 66 of the manifold assembly so that spill-out of the burner flames and combustion products produced within the combustion chamber 24 each time the main burner 40 is ignited cannot take place out through the closed off inner access opening 44. Relighting of the pilot light burner 50, should it become extinguished for some reason, is effected by swiveling the movable door 74 normally covering the pilot light port 72 to an open position to thereby uncover the port 72, so as to permit the re-ignition therethrough of the pilot light. Should servicing or adjustment of the main or pilot light burners 40 and 50 or of the pilot light actuated thermocouple 60 ever become necessary, the manifold assembly 70, in that case, would have to be completely disconnected from the water heater control or valve means 56 to permit the removal of the entire manifold assembly 70 from the water heater A, thereby rendering the water heater entirely inoperative to produce burner flames or combustion products that could spill-out through the uncovered access openings 44 and 46.

Having thus described the invention, it is claimed:

1. A water heater comprising a vertical water storage tank with an underlying combustion chamber comprised of a metal skirt member having an inner access opening into the side of said chamber, and a unitary manifold assembly mounted within and covering the said access opening to prevent spill-out therethrough of the burner flames, said manifold assembly including a main burner with its manifold gas supply tube, a pilot flame burner with its gas supply tube, a pilot burner control thermocouple with its support tube, and an inner door covering and closing off said access opening, said gas supply and support tubes extending through and sealed within apertures in said inner door to support the said burners and thermocouple in place thereon within said combustion chamber in horizontally opposite exposed relation to said access opening, and said unitary manifold assembly being entirely removable as a unit from said combustion chamber through said access opening.

2. A water heater as defined in claim 1, wherein gaskets surround and seal the said tubes in the said apertures in said inner door.

3. A water heater comprising a vertical storage tank with an underlying combustion chamber comprised of a metal skirt member having an inner access opening into the side of said chamber, and a unitary manifold assembly mounted within and covering the said access opening to prevent spill-out therethrough of the burner flames, said manifold assembly including a main burner with its manifold gas supply tube, a pilot flame burner with its gas supply tube, a pilot burner control thermocouple with its support tube, and an inner door covering and closing off said access opening, said gas supply and support tubes extending through and sealed within apertures in said inner door to support the said burners and thermocouple in place thereon within said combustion chamber, said inner door being provided with a pilot burner lighting port leading into the said combustion chamber, and a spring-loaded closure door movably mounted on said inner door to close off the said lighting port.

4. A water heater as defined in claim 3, wherein gaskets surround and seal the said tubes in the said apertures in said inner door.

5. A water heater comprising a vertical water storage tank with an underlying combustion chamber comprised of a metal skirt member having an inner access opening into the side of said chamber, a unitary manifold assembly mounted within and covering the said access opening to prevent spill-out therethrough of the burner flames, said manifold assembly including a main burner with its gas supply tube, a pilot flame burner with its gas supply tube, a pilot burner control thermocouple with its support tube, and an inner door covering and closing off said access opening, said gas supply and support tubes extending through and sealed within apertures in said inner door to support the said burners and thermocouple in place thereon within said combustion chamber, a piezo ignitor mounted within the said combustion chamber and operable from the exterior of the water heater to generate an ignitor spark within said combustion chamber for lighting said pilot burner, and said inner door being provided with a viewing port therein closed off by a tempered glass window for observation therethrough of the pilot flame from said pilot burner.

6. A water heater as defined in claim 5, wherein gaskets surround and seal the said tubes in the said apertures in said inner door.

7. A water heater as defined in claim 1, wherein an inner door gasket surrounds the said inner access opening in said skirt member and is interposed between said inner door and said skirt member to seal the inner door around the said inner access opening.

8. A water heater comprising a vertical water storage tank with an underlying combustion chamber comprised of a metal skirt member having an inner access opening into the side of said chamber, and a unitary manifold assembly mounted within and covering the said access opening to prevent spill-out therethrough of the burner flames, said manifold assembly including a main burner with its manifold gas supply tube, a pilot flame burner with its gas supply tube, a pilot burner control thermocouple with its support tube, and an inner door covering and closing off said access opening, said gas supply and support tubes extending through and sealed within apertures in said inner door to support the said burners and thermocouple in place thereon within said combustion chamber, the said inner door being comprised of an upper main door section provided with a notch opening in its bottom edge, and a bracket plate section permanently secured to said main door section and covering the said notch opening therein, the overlapping opposed edges of said notch opening and said bracket plate section being formed with a plurality of spaced pairs of opposed semi-circular recesses cojointly providing apertures of a size and contour corresponding to respective ones of said manifold tube, pilot burner tube, and thermocouple tube to snugly fit therearound.

9. A water heater as defined in claim 8, wherein the semi-circular edges of said apertures are flanged to provide added support for the said tubes fitted therethrough.

10. A gas fired water heater comprising a vertical water storage tank with a combustion chamber disposed in heat transfer relation thereto at the bottom region of the tank, said combustion chamber having an access opening thereinto in the side wall thereof, a main gas burner mounted within said combustion chamber, and a unitary manifold assembly mounted within and covering the said access opening to prevent spill-out therethrough of the gas burner flames, said manifold assembly including the said main burner with its manifold gas supply tube and a door member covering and closing off said access opening, said gas supply tube extending through and sealed within an aperture in said door member to support the said burner in place thereon within said combustion chamber in horizontally opposite exposed relation to said access opening, and said unitary manifold assembly being entirely removable as a unit from said combustion chamber through said access opening.

11. A water heater as defined in claim 10, wherein a gasket surrounds and seals the said manifold gas supply tube in the said aperture in said door member.

12. A water heater as defined in claim 10, wherein the said manifold assembly also includes a pilot flame burner with its gas supply tube and a pilot burner control thermocouple with its support tube, said gas supply and support tubes extending through and sealed within respective apertures in said door member to support the said burners and thermocouple in place thereon within said combustion chamber.

13. A water heater as defined in claim 12, wherein gaskets surround and seal all the said tubes in the said apertures in said door member.

14. A gas fired water heater comprising a vertical water storage tank with a combustion chamber disposed in heat transfer relation thereto at the bottom region of the tank, said combustion chamber having an access opening thereinto in the side wall thereof, a main gas burner mounted within said combustion chamber, and a unitary manifold assembly mounted within and covering the said access opening to prevent spill-out therethrough of the gas burner flames, said manifold assembly including the said main burner with its manifold gas supply tube and a door member covering and closing off said access opening, said manifold assembly also including a pilot flame burner with its gas supply tube and a pilot burner control thermocouple with its support tube, said gas supply and support tubes extending through and sealed within respective apertures in said door member to support the said burners and thermocouple in place thereon within said combustion chamber, a pilot burner lighting port being provided in said door member leading into the said combustion chamber, and a closure door being movably mounted on said door member to close off the said lighting port.

15. A gas fired water heater comprising a vertical water storage tank with a combustion chamber disposed in heat transfer relation thereto at the bottom region of the tank, said combustion chamber having an access opening thereinto in the side wall thereof, a main gas burner mounted within said combustion chamber, and a unitary manifold assembly mounted within and covering the said access opening to prevent spill-out therethrough of the gas burner flames, said manifold assembly including the said main burner with its manifold gas supply tube and a door member covering and closing off said access opening, said manifold assembly also including a pilot flame burner with its gas supply tube and a pilot burner control thermocouple with its support tube, said gas supply and support tubes extending through and sealed within respective apertures in said door member to support the said burners and thermocouple in place thereon within said combustion chamber, a piezo ignitor being mounted within the said combustion chamber and operable from the exterior of the water heater to generate an ignitor spark within said combustion chamber for lighting said pilot burner, and a viewing port being provided in said door member closed off by a tempered glass window for observation therethrough of the pilot flame from said pilot burner.

16. A water heater as defined in claim 15, wherein gaskets surround and seal all of the said tubes in the said apertures in said door member.

17. A water heater as defined in claim 10, wherein a door gasket surrounds the said access opening in the said side wall of said combustion chamber and is interposed between said door member and said side wall of said combustion chamber to seal the door member around the said access opening.

18. A gas fired water heater comprising a vertical water storage tank with a combustion chamber disposed in heat transfer relation thereto at the bottom region of the tank, said combustion chamber having an access opening thereinto in the side wall thereof, a main gas burner mounted within said combustion chamber, and a unitary manifold assembly mounted within and covering the said access opening to prevent spill-out therethrough of the gas burner flames, said manifold assembly including the said main burner with its manifold gas supply tube and a door member covering and closing off said access opening, said gas supply tube extending through and sealed within an aperture in said door member to support the said burner in place thereon within said combustion chamber, the said door member being comprised of an upper main door section provided with a notch opening in its bottom edge, and a bracket plate section permanently secured to said main door section and covering the said notch opening therein, the overlapping opposed edges of said notch opening and said bracket plate section being formed with an opposed pair of semi-circular recesses cojointly providing an aperture of a size and contour corresponding to the said gas supply tube to snugly fit therearound.

19. A water heater as defined in claim 18, wherein the semi-circular edges of said aperture are flanged to provide added support for the said gas supply tube.

20. A gas fired water heater comprising a vertical water storage tank with a combustion chamber disposed in heat transfer relation thereto at the bottom region of the tank, said combustion chamber having an access opening thereinto in the side wall thereof, a main gas burner mounted within said combustion chamber, and a unitary manifold assembly mounted within and covering the said access opening to prevent spill-out therethrough of the gas burner flames, said manifold assembly including the said main burner with its manifold gas supply tube and a door member covering and closing off said access opening, said manifold assembly also including a pilot flame burner with its gas supply tube and a pilot burner control thermocouple with its support tube, said gas supply and support tubes extending through and sealed within respective apertures in said door member to support the said burners and thermocouple in place thereon within said combustion chamber, the said door member being comprised of an upper main door section provided with a notch opening in its bottom edge, and a bracket plate section permanently secured to said main door section and covering the said notch opening therein, the overlapping opposed edges of said notch opening and said bracket plate section being formed with a plurality of spaced pairs of opposed semi-circular recesses conjointly providing apertures of a size and contour corresponding to respective ones of said manifold gas supply tube, said pilot burner gas supply tube, and said thermocouple support tube to snugly fit therearound.

21. A water heater as defined in claim 20, wherein the semi-circular edges of said apertures are flanged to provide added support for the tubes fitted therethrough.

22. A gas fired water heater comprising a vertical water storage tank with a combustion chamber disposed in heat transfer relation thereto at the bottom region of the tank, said combustion chamber having an access opening thereinto in the side wall thereof, a main gas burner mounted within said combustion chamber, and a unitary manifold assembly mounted within and covering the said access opening to prevent spill-out therethrough of the gas burner flames, said manifold assembly including the said main burner with its manifold gas supply tube and a door member covering and closing off said access opening, said manifold assembly also including a pilot flame burner with its gas supply tube and a pilot burner control thermocouple with its support tube, said gas supply and support tubes extending through and sealed within respective apertures in said door member to support the said burners and thermocouple in place thereon within said combustion chamber, the said pilot burner gas supply tube and the said thermocouple support tube being additionally supported in place within the said combustion chamber within a mounting bracket brazed to the said manifold gas supply tube to thereby mount the said pilot burner in operative relation to the said main burner and the said thermocouple in operative relation to the said pilot burner.

* * * * *

UNITED STATES PATENT AND TRADEMARK OFFICE

CERTIFICATE OF CORRECTION

PATENT NO. : 4,924,816

DATED : May 15, 1990

INVENTOR(S) : Henry J. Moore, Jr.; Bijan Gidanian

Figure 1B:
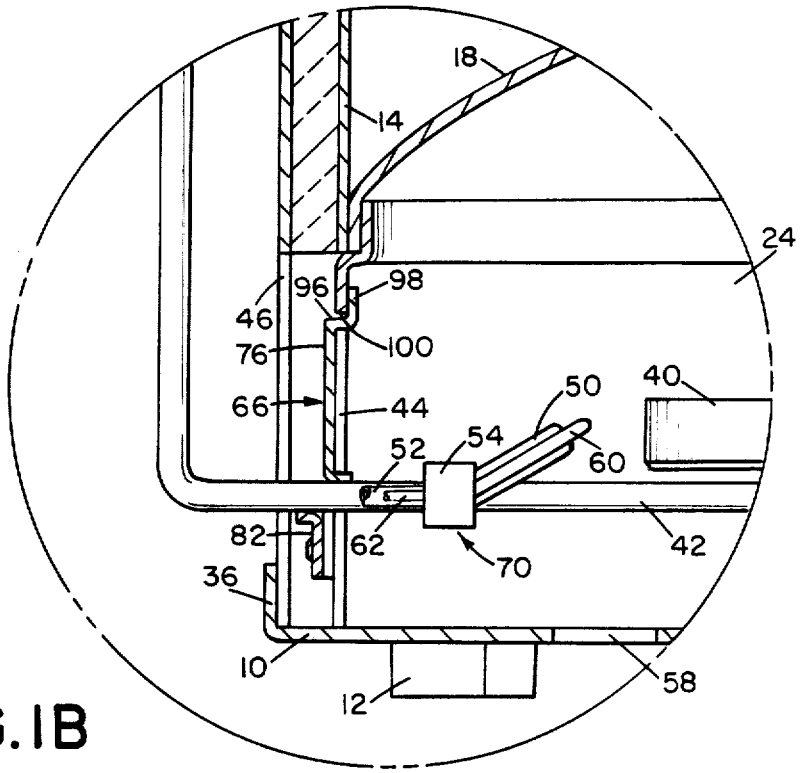
FIG. 1B is an enlarged fragmentary view of the circled portion of the water heater shown in FIG. 1A.
Figure 2:
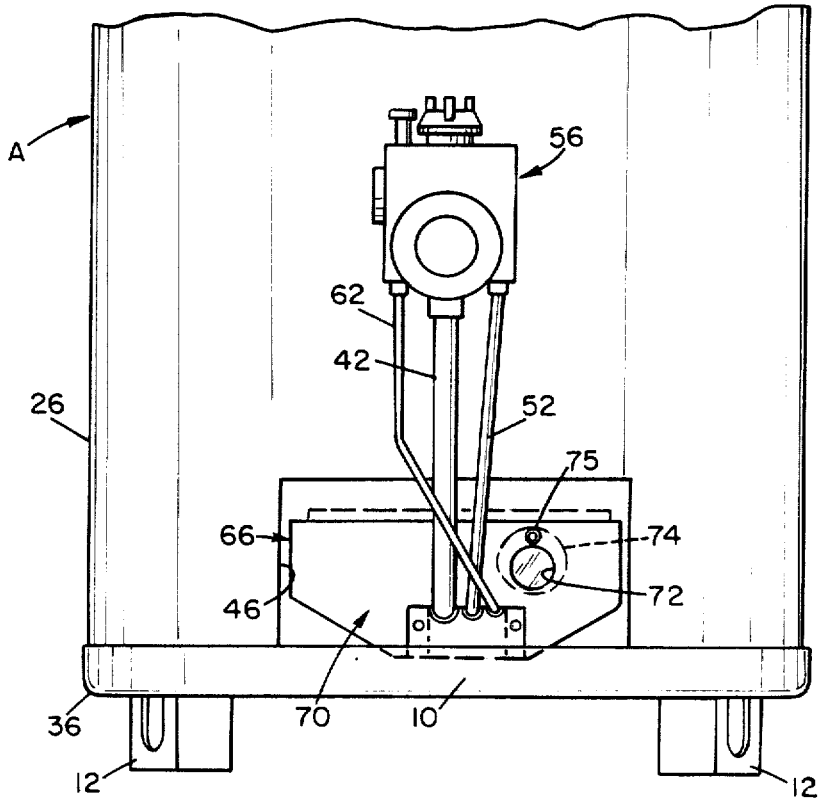
FIG. 2 is a fragmentary elevational view of the water heater as viewed on the line 2—2 of FIG. 1.

It is certified that error appears in the above-identified patent and that said Letters Patent is hereby corrected as shown below:

Column 2, line 48, "FIG. 1" should read --- FIG. 1A ---. Column 3, line 37, "provide" should read --- provided ---; line 60, delete "of". Column 4, "opening" should read --- openings ---; line 58, after "40" the semicolon (;) should be a comma(,). Column 5, line 39, "88', 90' and 92'" should read --- 88'', 90'' and 92'' ---; line 41, "88", 90" and 92"" should read --- 88', 90' and 92' ---. Claim 8, line 23, "cojointly" should read --- conjointly ---. Claim 18, line 22, "cojointly" should read --- conjointly ---.

Signed and Sealed this

Twenty-fifth Day of February, 1992

*Attest:*

HARRY F. MANBECK, JR.

*Attesting Officer*

*Commissioner of Patents and Trademarks*